US005290144A

United States Patent [19]

Kreitmeier

[11] Patent Number: 5,290,144

[45] Date of Patent: Mar. 1, 1994

[54] SHROUD RING FOR AN AXIAL FLOW TURBINE

[75] Inventor: Franz Kreitmeier, Baden, Switzerland

[73] Assignee: Asea Brown Boveri Ltd., Baden, Switzerland

[21] Appl. No.: 951,839

[22] Filed: Sep. 28, 1992

[30] Foreign Application Priority Data

Oct. 8, 1991 [CH] Switzerland ..... 2965/91

[51] Int. Cl.[5] ..... F01D 11/02

[52] U.S. Cl. ..... 415/173.1; 415/171.1; 415/173.6

[58] Field of Search ..... 415/170.1, 171.1, 173.1, 415/173.6; 416/191

[56] References Cited

U.S. PATENT DOCUMENTS

| | | | |
|---|---|---|---|
| 2,910,269 | 10/1959 | Howorth et al. | 415/173.6 |
| 3,677,660 | 7/1972 | Taniguchi et al. | 415/173.6 |
| 3,876,330 | 4/1975 | Pearson et al. | 415/173.6 |
| 4,295,787 | 10/1981 | Lardellier | 415/173.6 |
| 4,370,094 | 1/1983 | Ambrosch et al. | 415/173.6 |
| 4,576,551 | 3/1986 | Oliver et al. | 415/173.6 |
| 4,623,298 | 11/1986 | Hallinger et al. | 415/173.6 |
| 4,662,820 | 5/1987 | Sasoda et al. | 415/173.6 |
| 4,710,102 | 12/1987 | Ortolano | 416/191 |

FOREIGN PATENT DOCUMENTS

| | | | |
|---|---|---|---|
| 485833 | 8/1925 | Fed. Rep. of Germany | 415/173.6 |
| 1300577 | 8/1969 | Fed. Rep. of Germany | 416/191 |
| 2745130 | 4/1979 | Fed. Rep. of Germany | 415/173.6 |

*Primary Examiner*—John T. Kwon
*Attorney, Agent, or Firm*—Burns, Doane, Swecker & Mathis

[57] ABSTRACT

In a device for sealing the gap between the rotor blades and the casing (2) of a turbomachine, configured with a conical profile (28), the rotor blades (6) are provided with circumferential shroud plates (11), which seal by serrations (12, 13, 14, 15) against the casing with the formation of radial gaps (16, 17, 18). The shroud plate (11), which is arranged at the end of the blade, has four throttle locations relative to the casing, the inlet end throttle location bounding a diagonal gap (19) and the outlet end throttle location forming a radial gap (16).

9 Claims, 1 Drawing Sheet

FIG. 1
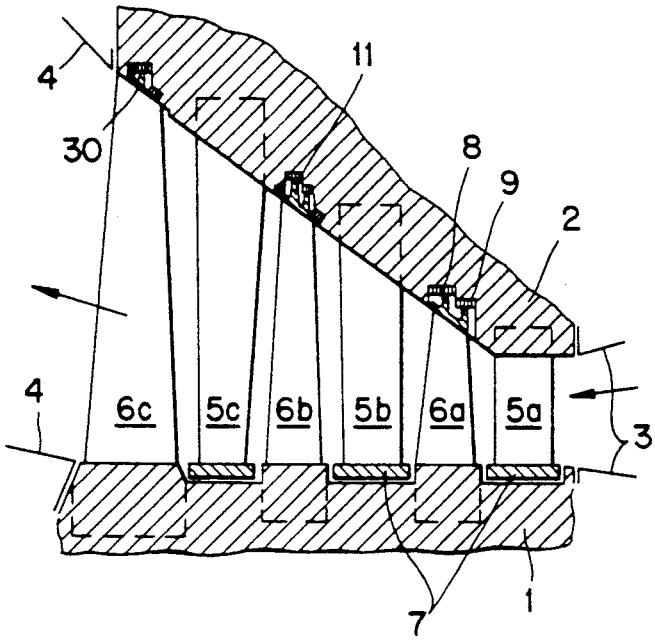
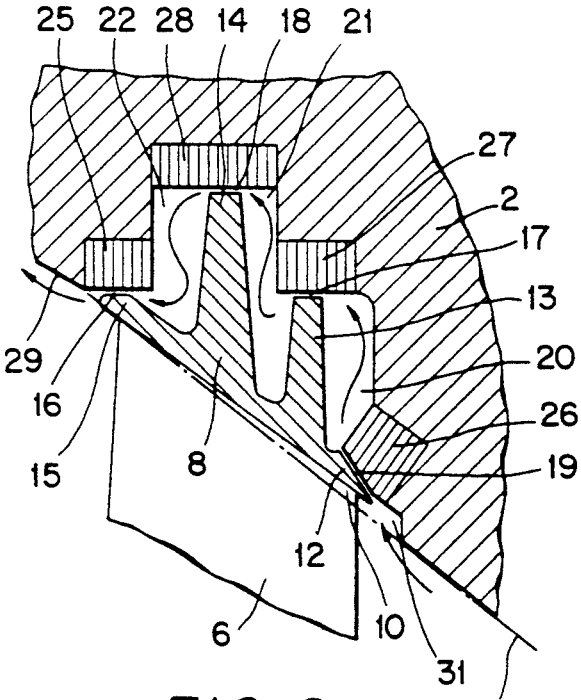
FIG. 2
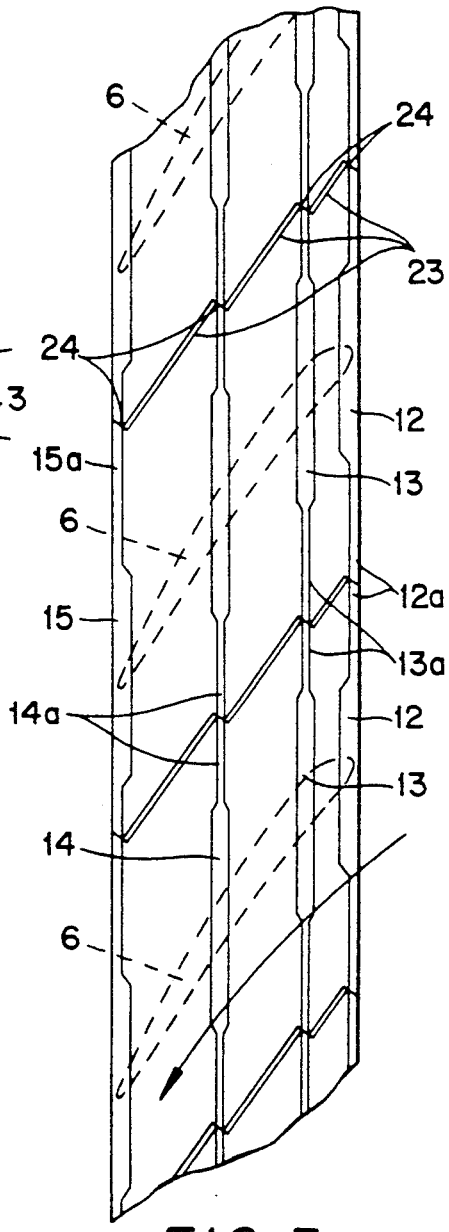
FIG. 3

SHROUD RING FOR AN AXIAL FLOW TURBINE

BACKGROUND OF THE INVENTION

1. Field of the invention

The invention concerns a device for sealing the gap between the rotor blades and the casing of a turbomachine, configured with a conical profile, in which the rotor blades are provided with circumferential shroud plates, which seal by means of serrations against the casing with the formation of radial gaps.

2. Discussion of Background

Devices of this type are known. They consist essentially of shroud plates with serrations running in the circumferential direction and sealing against the casing or against a honeycomb arrangement. They form a see-through or a stepped labyrinth with purely radial gaps. As a rule, these shroud plates extend over the whole of the blade axial chord. A known sealing configuration of this type, having two sealing serrations, is represented by the first stage rotor blades in FIG. 1, which will be described later.

A disadvantage with these sealing configurations are the two large vortex spaces which are formed in front of and behind the serrations and result in a large dissipation. In addition, the open spaces render the cooling of the shroud plates more difficult.

SUMMARY OF THE INVENTION

Accordingly, one object of the invention is, in the case of blades of the type stated at the outset, to guarantee cleaner guidance of the main flow and to provide a shroud ring which, in addition to a good sealing action, is also amenable to efficient cooling.

This is achieved, according to the invention, by virtue of the fact that the shroud plate, which is arranged at the end of the blade, has four throttle locations relative to the casing, the inlet end throttle location forming a diagonal gap in the steady-state operating condition. The outlet end throttle location preferably forms a radial gap.

One of the advantages of the invention is to be regarded as the fact that only small gap mass flows occur with the new sealing configuration. As a result, it is possible to achieve high efficiencies. In addition, good introduction of the gap flow into the main flow is achieved.

It is particularly useful for the shroud plates to be configured so that they are symmetrical about the axis of rotation and for the dividing lines between adjacent shroud plates to extend in the direction of the profile chord. With this configuration the unavoidable leakage flow between the shroud plates is turned in the direction of the main flow.

It is, furthermore, advantageous for the dividing line to be provided with four steps, the steps extending in the axial plane of the three throttle locations. During operation of the turbomachine, adjacent shroud plates come into contact in these steps as a result of blade untwist. This creates the necessary damping effect.

It is advantageous for the inlet end of the blade to have a smaller hade angle than the casing profile. This hade angle should be dimensioned such that a positive offset occurs at the end of the blade, having its largest value in the vicinity of the blade leading edge and protruding together with the associated shroud plate part into a gap relief chamber arranged in the casing. This gap relief achieves a reduction of the leakage flow over the shroud ring because the main flow near the gap is diverted away from it.

If, in addition, the casing is provided with honeycomb arrangements at the four throttle locations, no damage to the highly sensitive shroud ring is to be expected in the event of a rub, these honeycomb sealing configurations also ensure that the heat generated in the event of a rub remains as low as possible. Hence the mechanical properties of the highly loaded elements involved also remain intact.

Finally, it is advantageous for the serrations of the shroud plates forming the throttle locations to be tapered in the circumferential direction at the shroud plate overhangs, so as to reduce the weight of the shroud plates.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, showing an axial flow gas turbine, wherein:

FIG. 1 shows a partial longitudinal section of the gas turbine;

FIG. 2 shows a partial cross-section through the sealing device of the second rotor blade row;

FIG. 3 shows the partial development of a plan view of the ends of the blades of the second rotor blade row.

DESCRIPTION OF THE PREFERRED EMBODIMENTS

Referring now to the drawings, wherein like reference numerals designate identical or corresponding parts throughout the several views, only those elements essential for understanding the invention are shown. For example, the adjacent components of the installation, such as the combustion chamber, outlet diffuser and blade roots are only indicated. The blade cooling usual in this type of machine is not represented. The flow direction of the working media is indicated by arrows. In FIG. 1 the three-stage gas turbine consists essentially of the bladed rotor 1 and the vane carrier 2 fitted with nozzle guide vanes. The vane carrier, which exhibits a steep conical duct profile of 40°, is suspended inside a turbine casing (not shown). In what follows, the term vane carrier has the same meaning as the term casing. The working medium enters the turbine from the outlet of the combustion chamber 3. The flow duct of the turbine emerges into the exhaust casing, of which only the internal walls 4 of the diffuser are shown. The blading consists of three nozzle guide vane rows 5*a*, 5*b* and 5*c* and three rotor blade rows 6*a*, 6*b* and 6*c*. The vanes of the nozzle guide vane rows seal against the rotor 1 by means of shroud rings 7. The blades of the first rotor blade row 6*a* are provided with the shroud plate sealing configuration 8 referred to at the outset and known per se. The actual sealing configuration consists of circumferential serrations which run against a honeycomb arrangement 9. The shroud plates, which extend over the whole of the blade axial chord, form a stepped labyrinth with purely radial gaps.

The highly loaded rotor blades 6 of the outlet rotor blade row 6*c* are each provided with a shroud plate 30 arranged centrally at the end of the blade and forming three throttle locations relative to the vane carrier 2.

The blades of the central rotor blade row are provided with shroud plates 11 which, in accordance with FIG. 2, form four throttle locations relative to the vane carrier 2. For this purpose the plates are provided in four different radial planes with circumferential serrations 12, 13, 14 and 15. The outlet end serration 15, together with a honeycomb arrangement 25 set into the vane carrier 2, forms a radial gap 16. The central serrations 13 and 14, with the opposite honeycomb arrangements 27 and 28, likewise form radial gaps 17 and 18 respectively. The inlet end serration 12 runs diagonally and, together with a correspondingly configured honeycomb arrangement 26, forms a diagonal gap 19. Let it be assumed in the present case that the rotor and the casing approach one another during operation due to the large relative axial expansions. Thus, FIG. 2 shows the operating position, i.e. the position in which the diagonal gap 19 represents the operating clearance. The axial expansion is thus used to create a throttle gap.

The four serrations enclose three vortex chambers 20, 21, 22, which, because of the radial stagger between the throttle locations, do not affect each other.

The new type of sealing configuration at the outlet by means of a radial gap produces an outlet flow directed cleanly into the flow duct in comparison with the previous free vortex spaces at this location such as those in the shroud plate sealing configuration 8 in the first rotor blade row 5*b*. The flow duct wall 29 which adjoins the honeycomb arrangement 25 is initially slightly rounded before it makes the transition to the slope of the duct profile. By means of this measure, a deflecting Coanda effect is exerted on the gap flow emerging from the radial gap 16, with the result that the main flow is impaired as little as possible.

According to FIG. 2, the end of the blade is provided with a positive offset 10 at its inlet end. This offset is formed by virtue of the fact that the blade tip hade, that is, the angle the blade tip makes with the vertical, is smaller than the angle formed by the surface of the duct 32 with the vertical. The offset 10 projects together with the shroud plate part associated with it into a gap relief chamber 31 arranged in the vane carrier 2. The inner profile of the gap relief chamber is matched to the hade of the blade tip. This unloads the blade gap aerodynamically. The pressure difference across the blade gap is lowered and the deflection is improved. The net result is a reduction in the so-called gap losses.

In FIG. 3, it can be seen that the shroud plates 11 are configured so as to be symmetrical about the axis of rotation. The dividing lines 23 between adjacent shroud plates extend in the direction of the profile chord. The sides of the shroud plates in the peripheral direction are provided with four steps 24. These steps extend in the axial planes of the four sealing serrations in order to ensure continuous sealing at the sealing surfaces. In addition, these steps provide the mechanical coupling between the shroud plates for the purpose of achieving the damping effect. The serrations 12, 13, 14 and 15 are tapered in the circumferential direction at the two overhangs of each shroud plate. These tapers 12*a*, 13*a*, 14*a* and 15*a* contribute substantially to weight saving in the shroud plates.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A device for sealing the gap between the rotor blades and the casing of a turbomachine, configured with a conical profile, in which the rotor blades are provided with circumferential shroud plates, which seal by means of serrations against the casing with the formation of radial gaps, wherein the shroud plate, which is arranged at the end of the blade, has four throttle locations relative to the casing, the inlet end throttle locating forming a diagonal gap in the steady-state operating condition.

2. The device as claimed in claim 1, wherein the outlet end throttle location forms a radial gap.

3. The device as claimed in claim 1, wherein the shroud plates are configured so as to be symmetrical about the axis of rotation.

4. The device as claimed in claim 1, wherein the dividing lines between adjacent shroud plates till extend in the direction of the profile chord.

5. The device as claimed in claim 4, wherein the dividing line fill is provided with four steps, the steps extending in the axial plane of the serrations.

6. The device as claimed in claim 1, wherein the casing is provided with honeycomb arrangements at the four throttle locations.

7. The device claimed in claim 1, wherein the casing is provided with a gap relief chamber at the inlet end of the blade, and the end of the blade the is angled relative to the casing profile at the inlet such that a resulting positive offset at the end of the blade portion together with the associated shroud plate part into the gap relief chamber formed in the casing.

8. The device as claimed in claim 1, wherein the serrations of the shroud plates forming the throttle locations are tapered in the circumferential direction at the shroud plate overhangs.

9. The device as claimed in claim 1, wherein the flow duct wall which adjoins the outlet end honeycomb arrangement is slightly rounded before it makes the transition to the slope of the duct profile.

* * * * *